United States Patent [19]

Rizzo

[11] Patent Number: 5,048,132

[45] Date of Patent: Sep. 17, 1991

[54] BATH/SHOWER SEAT ASSEMBLY AND ENCLOSURE

[76] Inventor: Phyllis Rizzo, 67-27 Eliot Ave., Middle Village, N.Y. 11379

[21] Appl. No.: 472,126

[22] Filed: Jan. 30, 1990

[51] Int. Cl.[5] ..... A47K 3/12

[52] U.S. Cl. ..... 4/578; 4/611; 297/14

[58] Field of Search ..... 4/630, 572, 575, 579, 4/559, 464, 605, 661, 571, 573, 578, 611; 297/15, 14; 248/240.1; 108/42, 48; 312/313, 314

[56] References Cited

U.S. PATENT DOCUMENTS

| | | | |
|---|---|---|---|
| 279,290 | 6/1883 | Von Der Wulbeke | 108/48 |
| 279,986 | 6/1883 | Shuler | 108/48 |
| 667,164 | 1/1901 | Carder | 108/48 X |
| 875,840 | 1/1908 | Olsen | 108/48 |
| 1,668,386 | 5/1928 | Talbott | 297/14 |
| 1,723,511 | 8/1929 | Johnston | 297/14 |
| 1,731,567 | 10/1929 | Gilbert et al. | 4/630 X |
| 1,761,673 | 6/1930 | Laursen | 297/14 |
| 1,923,482 | 8/1933 | Frankenstein | 4/572 X |
| 2,719,306 | 10/1955 | Levitt | 4/572 X |
| 2,755,156 | 7/1956 | Nichols | 312/314 |
| 2,792,053 | 5/1957 | Kursman | 248/240.1 |
| 2,813,276 | 1/1957 | Lanza | 4/579 |
| 2,965,153 | 12/1960 | Purcell, Sr. | 4/578 X |
| 3,317,928 | 5/1967 | Root | 4/578 X |
| 3,319,265 | 5/1967 | Losada | 4/572 |
| 3,579,668 | 5/1971 | Aronovitz | 4/578 |
| 4,087,127 | 5/1978 | Lotta | 297/14 |
| 4,400,835 | 8/1983 | Richter | 4/578 |

*Primary Examiner*—Henry J. Recla
*Assistant Examiner*—Robert M. Fetsuga
*Attorney, Agent, or Firm*—Barry G. Magidoff

[57] ABSTRACT

There is provided for use in a bathtub or shower, a folding seat assembly, which is mounted on a wall, and which includes an additional seat support which is also attached to the wall at a height above that of the seat. When folded, the mechanism is substantially contained within an enclosure.

8 Claims, 3 Drawing Sheets

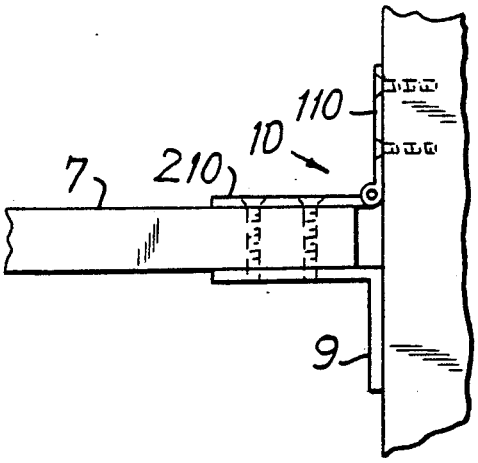
FIG. 2
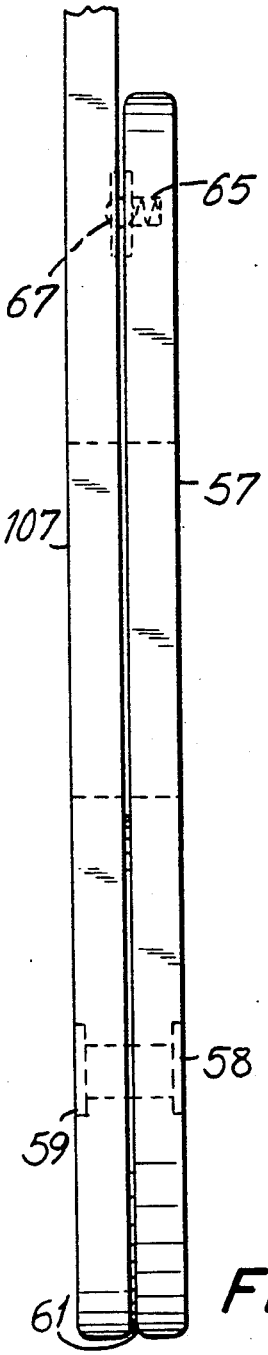
FIG. 5
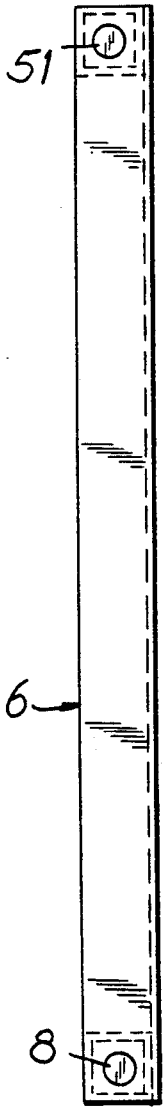
FIG. 4
FIG. 3
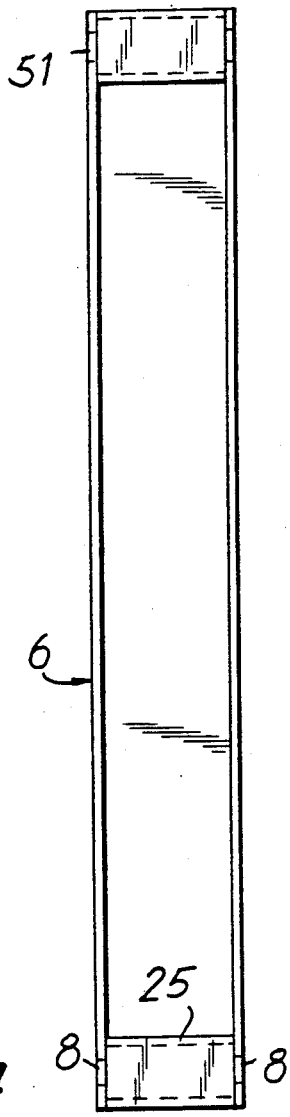

BATH/SHOWER SEAT ASSEMBLY AND ENCLOSURE

FIELD OF THE INVENTION

This invention relates to bath/shower fixtures and pertains particularly to a collapsible seat that is adapted to be mounted on a wall adjacent to a bathtub or within a shower stall so that it can be used while bathing.

The main object of this invention is to provide a seat which will aid invalids and semi-invalids who risk serious accidents as a result of slipping while using a tub. It is designed to relieve the stresses and danger to the handicapped or infirm, while standing in a bathtub or shower or attempting to sit in a bathtub. Those who are unsteady on their feet will also be able to wash their feet while showering, without having to stand on one foot in order to do so.

BACKGROUND OF THE INVENTION

There are a number of prior art devices which seek to perform similar functions. However, these all have disadvantages which it is an object of the present invention to eliminate.

An investigation of the prior art shows that there are two main categories of this kind of device. One of them has as its main characteristic, a seat mounted on the rear wall of the bathtub. This configuration has a number of disadvantages. These include the fact that the user, while seated at the end of the bathtub away from the shower fixture, may well be outside of the stream of the shower. Also, the distance from the seat to the controls is likely to be such that the water could not be adjusted while the user is seated.

The other main category of such devices includes one or more supports which rest on the side or the bottom of the tub. The disadvantages of this configuration are that the supports may themselves cause injury and also may cause damage to the bathtub. Furthermore, some supports may not work adequately with irregularly shaped bathtubs.

SUMMARY OF THE INVENTION

The present invention relates particularly to a foldable seat for use in a bathtub or shower. The supports for this seat are mounted on the side wall of the bathtub or shower and it can be positioned at the most convenient location on such wall. The end of the seat away from the wall is further supported by a beam attached to that end of the seat and mounted on the wall above the level of the seat. This beam eliminates the need for a support leg resting on the side or bottom of the tub. As a result of its position at the rear of the seat and above the level of the seat, it can also function as a back support.

When the device is in use, the bather is seated facing the shower fixture. As a further aid to bathing, the seat has a cutout opening which results in improved access to the lower parts of the body.

When not in use, the device folds into a cabinet mounted on the wall at the side of the bathtub or shower, and is easily accessible to the user.

In a further embodiment, the present invention provides a transverse seating surface to permit ease of washing around the body without having to stand up, and to ease the problem of entering and leaving a bathtub/shower situation.

DESCRIPTION OF THE DRAWING

The achievement of the objects, and the advantages of the present invention will become apparent from the following description read in conjunction with the drawings.

FIG. 2 is a partial cross-sectional view taken along lines 2—2 of FIG. 1;

FIGS. 3 and 4 are bottom and side views, respectively, of the lower channel member support.

FIG. 5 is a partial side view of a second embodiment of this invention, providing a pivoting second seat member.

DESCRIPTION OF THE PREFERRED EMBODIMENT

Figure 1:
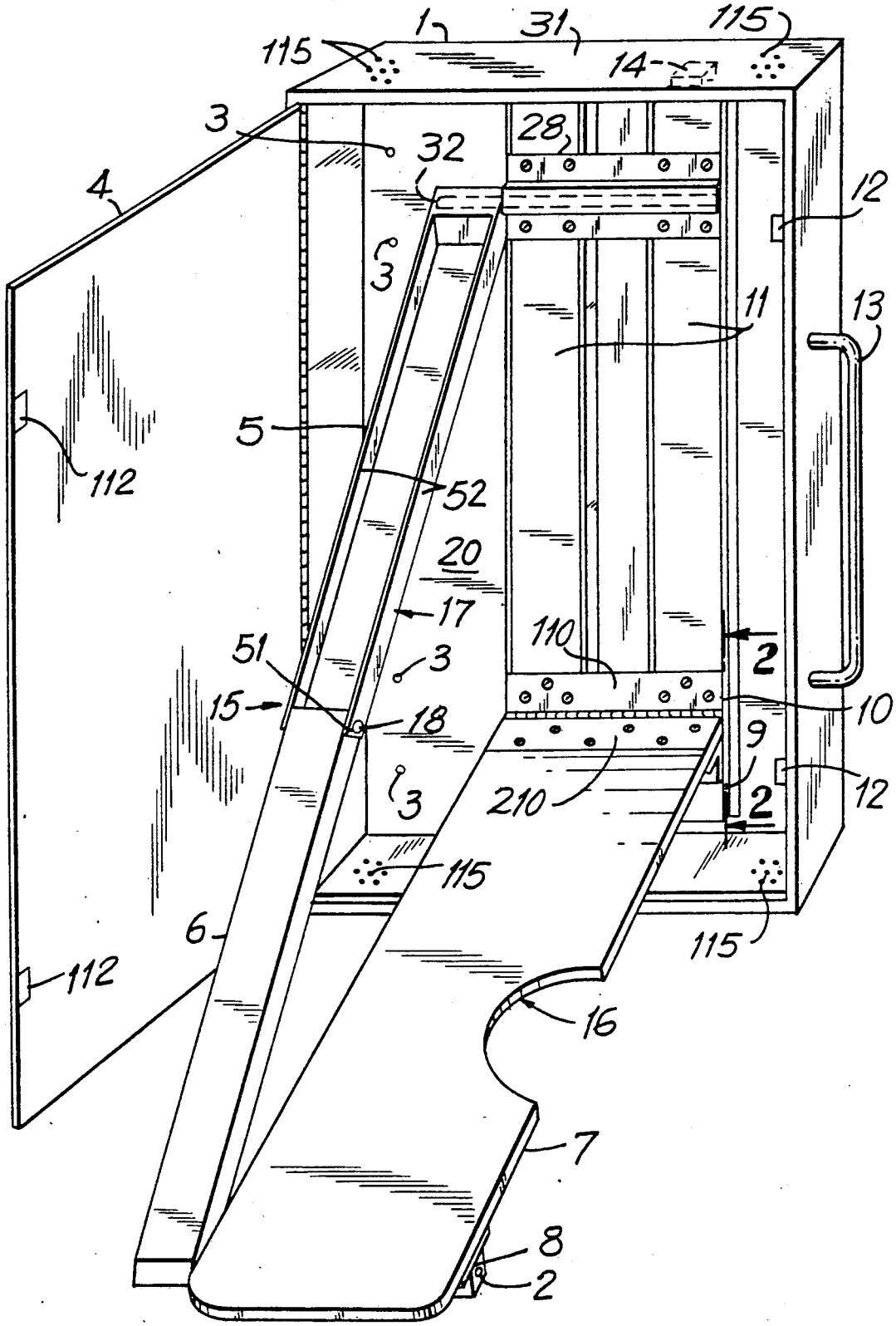
FIG. 1 is an isometric view of a preferred embodiment of this invention.

This device, when not in use, is completely contained in a cabinet or enclosure 1, which can be installed in a recessed fashion in new construction, or mounted, using standard procedures, on existing walls. The enclosure 1 can be fabricated from corrosion resistant stainless steel or aluminum. It can also be made from high impact thermoplastics by using the process of injection molding, or from painted marine plywood.

There are a series of mounting holes 3 in the rear panel 20 of the enclosure. These can be on 16″ centers in order to accommodate standard wall studding. If studs are not available, alternative devices such as plastic anchors, lag bolts or molly type fasteners can be used.

The supporting seat 7 can rotate between an extended position substantially parallel to the floor of the bath or shower and a vertically extending folded position within the enclosure 1. This seat can be fabricated from sealed hard-grained wood or can be injection molded using high impact thermoplastics. The seat has a cutout portion 16 in the side facing the shower fixture, the purpose of which is to aid in the bathing of the user's perineum area.

The body supporting seat 7 is secured to the rear panel 20 of the enclosure by means of a stainless steel pivotal hinge 10, which in turn is bolted or otherwise secured by one hinge plate 110 to the rear panel 20. The second hinge plate 210 is secured to the top surface of the seat 7. On the lower seat surface, opposite the second hinge plate 210, is a right angled rigid support bracket 9. Mounting holes in the bracket 9 mate with the holes through the hinge plate 210 and seat 7. The mounting holes can be threaded or a PEM nut can be used to terminate the hinge/seat screws. The angle bracket 9 is so placed so as to abut the rear panel 20 when the seat is lowered and to thus relieve some of the load stresses on the hinge.

On the bottom of the seat, at the distal end from the rear panel 20, are seat support journals 8 which house an outer seat journal pin 2; a coaxially aligned side journal 25 is secured to the outer end of a lower channel member support 6 and houses the outer portion of the outer seat journal pin 2, about which the seat 7 and the lower channel member 6, pivot. The outer seat journal pin 2 is as long as the width of the seat 7, plus the width of the lower channel member support 6.

A hinged seat support, generally indicated by the numeral 15, consists of an upper channel member support 5, and the lower channel member support 6; the two seat support channel members 5,6 are pivotally interconnected via a pivot pin 18, which extends through journal openings 51, 61 in the two support channel members 5, 6 at one end of each member. The upper channel seat support member 5 includes two transverse sides 17 which are separated by a distance slightly greater than the outer width of the lower channel seat support member 6. Thus, when the device is folded into the enclosure 1, the lower channel seat support member 6 can pivot about the stainless steel pin 18 so that the lower channel seat support member 6 is held between the two sides 17 of the upper channel seat support member 5, when the seat 7 is fully folded within the enclosure 1. At the upper end of the upper channel member support 5, the transverse sides 52 can be cut away to avoid interference with the journal pin 2. This will permit a full 180 degrees of relative rotation by the two support members. Otherwise, the relative rotation will be only about 170 degrees.

The upper channel member support 5 is pivotally attached to the rear panel 20 of the enclosure by means of a second panel support pin 32 around which it can pivot. A panel journal bracket 28, which is mounted to an upper portion of the rear panel 20 of the enclosure, can be juxtaposed so as to be coaxial with the panel support pin 32, to which it is journaled.

In the second embodiment of this invention, pivoting second seat member 57 is secured to a primary seat member 107, which has an outline substantially identical to that of the first embodiment seat 7, except as follows: a shoulder bolt 58 and torque nut 59 assembly, is secured to the second seat member 57 and primary seat 107, to permit adjusting the friction level between the two seat members 107,57; a relatively large diameter Teflon bearing/washer 61 is also held in place by the shoulder bolt 58, between the primary seat member 107 and secondary seat member 57.

A spring-loaded ball detent 65 is present adjacent the free end of the pivoting secondary seat 57. A ball socket 67, designed to mate with the ball detent 65, is formed into the primary seat member 7, facing the ball 65.

Figure 6:
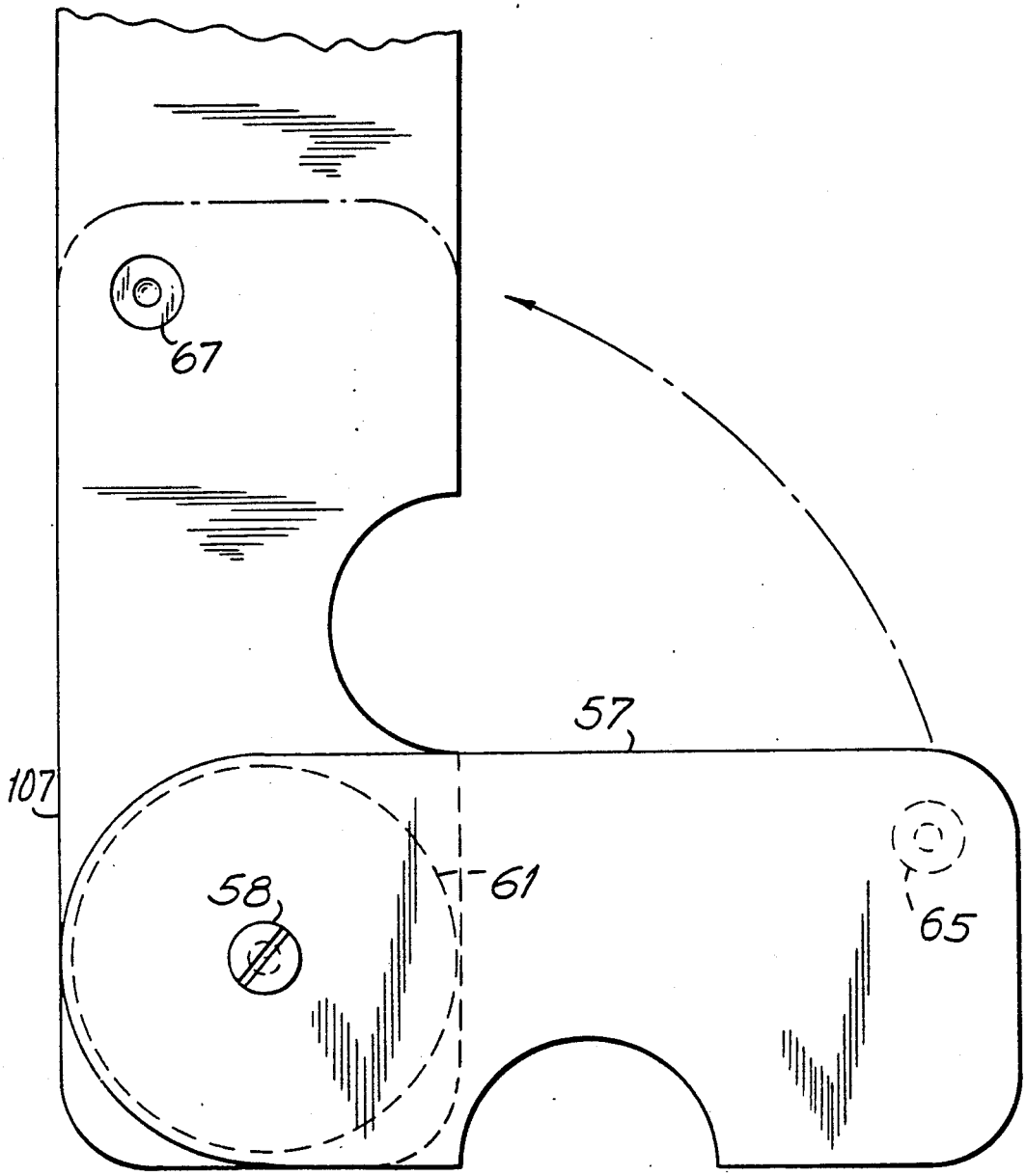
FIG. 6 is a top view of the embodiment of FIG. 5.

The primary seat member 107 is connected to the lower channel seat support member 6 by a system identical to that shown in FIGS. 1 through 4. The secondary seat member 57 is shown in the folded in position in FIG. 5, and the folded out position in FIG. 6. In use, the enclosure 1 is preferably secured to the wall above the long dimension of the tub, such that the primary seat 107 folds out towards the free side of the tub; the secondary seat can then pivot to the extended position shown in FIG. 6, extending along and parallel to the free side of the tub. This permits a person sitting on the secondary seat to swing their legs over the free side of the tub, thus easing transferring the patient into and out of the tub. The teflon bearing serves to reduce friction between the two seat members, 57,107, as the secondary seat 57 pivots.

The enclosure 1 has a hinged door 4, which can be transparent and can be made from, e.g., plexiglass, with a stainless steel hinge. It can also have a slatted type roll-up door of plastic or sealed wood on fabric. To keep the door 4 closed, there are door stop/catches 12, mounted on the opposing side of the enclosure and complementing latch means 112 on the facing end of the door 4. The latches can be made with either hook and loop material or with magnets mounted on corrosion resistant brackets.

On the rear wall of the enclosure, and as integral members of that structure, are main vertical support members 11, which can be members known as either "omega" or "hat" sections in the trade.

There is also a spring catch 14 mounted on the interior of the top panel 31 of the enclosure. Its purpose is to hold the end of the seat 7 in the closed position, and can be fabricated from stainless steel spring, having suitable memory characteristics.

On both the top and the bottom of the enclosure, there are a number of holes in rosette patterns 115, which provide a vent at the top and a drain at the bottom. Finally, on the side of the enclosure is a safety-support handle 13, which can be used as an aid to entering or egressing from the bath or shower. As with the enclosure itself, it can also be fabricated from corrosion resistant metals or plastics.

What is claimed is:

1. A folding bath seat assembly, which can be mounted on the side wall of a bathtub, comprising:

a) a wall mountable enclosure;

b) a hinge, one part of which is attached to a lower portion of the wall mountable enclosure;

c) an elongated seat member having upper and lower major surfaces, one end portion of which is attached to the other part of the hinge, so designed as to fold between an open position substantially perpendicular to the enclosure and a closed position substantially parallel to and adjacent to the enclosure, the hinge being secured to the upper major surface;

d) an elongated foldable seat support means pivotably attached at a first end to the other end portion of the seat member, and pivotably attached at a second end to an upper portion of the wall mounting enclosure, the seat support means and the seat member being so juxtaposed with respect to the enclosure, such that in the closed position of the seat member, the seat member and the seat support means are wholly within the enclosure;

e) an angle bracket support member rigidly secured to the lower major surface of the seat member opposite the hinge connection location and so designed as to abut the wall mounting enclosure when the seat member is in the open position.

2. A folding bath seat assembly as recited in claim 1, wherein the foldable seat support means comprises:

a. a lower elongated member, a first end of which is pivotably attached to the seat member, and having a journal opening extending transverse to the longitudinal axis of the elongated member and located adjacent the second end thereof;

b. an upper elongated member having a journal at a first end thereof that engages the journal opening, and a second end pivotally attached to the enclosure, said upper elongated member further having side outer flanges extending lengthwise of the member and separated sufficiently to permit nesting of the lower member;

c. the lower elongated member and the upper elongated member being so juxtaposed that the upper end of the lower elongated member is pinned between the two flanges and can pivot with respect to the upper member over at least about 170 degrees of rotation.

3. A folding bath seat assembly as recited in claim 2 wherein the upper elongated member comprises:

a. a pin, one end of which is attached to a bottom surface of the upper elongated member second end; and b. a support member secured within the enclosure and having a cavity inside of which the other end of the pin is secured.

4. A folding seat assembly as, recited in claim 3 wherein the seat support means is situated adjacent one side of the seat member and the seat member comprises a concave recess extending inwardly from the side opposite from the one adjacent the seat support member.

5. A folding seat assembly as recited in claim 4, wherein the enclosure further comprises:

a. a door hingedly attached to one side of the enclosure;

b. a sufficient number of door stops to hold the hinged door in a closed position when the seat assembly is in a folded position;

c. a plurality of openings into the enclosure, of a size and at a location adequate for the purposes of ventilation and drainage; and means for holding the seat member in place when the seat assembly is in a folded up position within the enclosure.

6. A folding seat assembly as recited in claim 5, wherein the enclosure further comprises a safety-support handle, attached to one side of the enclosure.

7. A folding seat assembly as recited in claim 8, further comprising a detent means to maintain the secondary seat member in the first position.

8. A folding bath seat assembly, which can be mounted on the side wall of a bathtub, comprising:

a) a wall mountable enclosure;

b) a hinge, one part of which is attached to a lower portion of the wall mountable enclosure;

c) an elongated seat member, one end portion of which is attached to the other part of the hinge, so designed as to fold between an open position substantially perpendicular to the enclosure and a closed position substantially parallel to and adjacent to the enclosure;

d) an elongated foldable seat support means pivotably attached at a first end to the other end portion of the seat member, and pivotably attached at a second end to an upper portion of the wall mounting enclosure, the seat support means and the seat member being so juxtaposed with respect to the enclosure, such that in the closed position of the seat member, the seat member and the seat support means are wholly within the enclosure;

e) a secondary seat member pivotably secured to the seat member at the second end portion of the seat member and designed to pivotally move from a first position overlapping and coincident with the seat member to a second position extending transversely to the seat member.

* * * * *

UNITED STATES PATENT AND TRADEMARK OFFICE

CERTIFICATE OF CORRECTION

PATENT NO. : 5,048,132

DATED : September 17, 1991

INVENTOR(S) : Phyllis Rizzo

It is certified that error appears in the above-identified patent and that said Letters Patent is hereby corrected as shown below:

Column 6, line 1, should be corrected to read as follows:

--8. A folding seat assembly as recited in Claim 7, fur- --.

Column 6, line 4, should be revised to read as follows:

--7. A folding bath seat assembly which can be--

Signed and Sealed this

Nineteenth Day of January, 1993

*Attest:*

*Attesting Officer*

DOUGLAS B. COMER

*Acting Commissioner of Patents and Trademarks*